US006042215A

United States Patent [19]

Imai

[11] Patent Number: 6,042,215

[45] Date of Patent: Mar. 28, 2000

[54] CAPPING DEVICE AND PRINTER INCLUDING THE SAME

[75] Inventor: Koji Imai, Nagoya, Japan

[73] Assignee: Brother Kogyo Kabushiki Kaisha, Nagoya, Japan

[21] Appl. No.: 08/922,336

[22] Filed: Sep. 3, 1997

[30] Foreign Application Priority Data

Sep. 4, 1996 [JP] Japan ..... 8-255566

[51] Int. Cl.[7] ..... B41J 2/165

[52] U.S. Cl. ..... 347/23; 347/29

[58] Field of Search ..... 347/23, 29, 26, 347/14

[56] References Cited

U.S. PATENT DOCUMENTS

| | | | |
|---|---|---|---|
| 4,684,963 | 8/1987 | Naka | 347/29 |
| 4,707,705 | 11/1987 | Hara et al. | 347/47 |
| 5,493,319 | 2/1996 | Hirabayashi et al. | 347/29 |
| 5,543,826 | 8/1996 | Kuronuma et al. | 347/23 |
| 5,805,181 | 9/1998 | Tanaka et al. | 347/29 |
| 5,867,184 | 2/1999 | Quintana | 347/29 |
| 5,912,681 | 6/1999 | Uetuki et al. | 347/29 |

FOREIGN PATENT DOCUMENTS

| | | | |
|---|---|---|---|
| 0 597 505 | 5/1994 | European Pat. Off. | 347/29 |

*Primary Examiner*—N. Le
*Assistant Examiner*—Shih-Wen Hsieh
*Attorney, Agent, or Firm*—Oliff & Berridge, PLC

[57] ABSTRACT

A printer has a temperature sensor for detecting its internal temperature. When a print head is covered with a cap of a cap unit, a machine temperature T1 is stored in a controller. After a lapse of a predetermined time, a machine temperature T2 is measured. If a predetermined temperature difference exists between T1 and T2, the cap is released transiently from the print head to prevent the pressure of the gap between the cap and the print head from reaching a level at which the meniscus is destroyed. Not only the machine temperature, but the elapsed time since the start of capping may be used as a basis for control.

21 Claims, 9 Drawing Sheets

CAPPING DEVICE AND PRINTER INCLUDING THE SAME

BACKGROUND OF THE INVENTION

1. Field of the Invention

The present invention relates to a capping device for a print head in a printing apparatus, and more particularly, a capping device and a printer including it for preventing the destruction of the meniscus of the print head.

2. Related Art of the Invention

To prevent the drying of ink ejection nozzles of a print head, it has been customary practice to cap the print head with a capping device. During the capping, the temperature of the space closed by the print head and the capping device (hereinafter referred to as the cap space) may vary under the influence of changes in the ambient temperature. In this situation, the volume of the cap space increases or decreases, and the pressure of the cap space varies. The meniscus of the print head is destroyed under a very low pressure. Thus, the pressure of the cap space needs to be kept at a low pressure at which the meniscus is not destroyed. As a means for keeping the pressure of the cap space constant, there has been proposed a maintenance mechanism for a print head, the maintenance mechanism having a communication passage between the cap space and the ambient air, and a valve mechanism in the communication passage, and controlling the opening and closing of the valve mechanism in response to changes in the temperature of the cap space. U.S. Pat. No. 4,684,963 discloses an ink jet printer equipped with a damper chamber which communicates with a cap chamber via a tube and which has a flexible member for absorbing pressure fluctuations inside the cap chamber.

With the above maintenance mechanism for the print head, however, the part other than the capping device, i.e., the valve mechanism, must be mounted for maintenance purposes. This poses the problems of making the structure complicated and the apparatus large.

SUMMARY OF THE INVENTION

The present invention has been accomplished to solve these problems. An object of the invention is to provide a capping device for a print head, and a printer including it, the capping device being capable of preventing the destruction of the meniscus due to pressure changes in the cap space by relying on a simple structure.

A first aspect of the present invention is to provide a capping device for a print head, comprising:

a cap unit having a cap for covering nozzles formed in the print head;

a driver for driving the cap unit between an intimate contact position of the cap with the print head and a release position of the cap from the print head;

a temperature sensor for detecting the temperature of the capping device; and a controller which, if the temperature detected by the temperature sensor is higher than a predetermined temperature, controls the driver so that the cap is released from the print head.

According to the capping device of the present invention, the temperature sensor detects the temperature of the capping device or the ambient temperature. If the temperature detected by the temperature sensor has changed to a level higher than the predetermined temperature, the controller controls the driver so as to release the cap from the print head. The predetermined temperature is set to be lower than a temperature at which the meniscus of the print head is destroyed. In this case, when the temperature of the gap between the cap and the print head varies to change its volume, the cap leaves the print head. By this mechanism, the pressure of the gap is always kept lower than the pressure high enough to destroy the meniscus. Consequently, printing malfunction can be prevented.

The capping device may further have a timer for measuring the time for which the print head is in intimate contact with the cap. If the time measured by the timer reaches a predetermined time and if the temperature detected by the temperature sensor exceeds a predetermined temperature, the controller can control the driver so that the cap is released from the print head. The predetermined time is a time set to be shorter than the time during which the atmosphere of the gap between the cap and the print head will fall into a state of meniscus destruction. This time can be set suitably in consideration of the environment where the printer with the print head is used, the frequency of use of the printer, the viscosity of ink, and so on. By so controlling the timing of release of the cap from the print head based not only on the temperature but also on the time, it can be detected more reliably that the pressure of the gap between the cap and the print head has approached the pressure at which the meniscus is destroyed. Compared with detection by temperature alone or detection by time alone, the above type of detection can decrease the frequency of release of the cap from the print head, make the nozzles dry with difficulty, and prevent the deterioration of the cap.

There may be a constitution in which the controller is connected to the printer having the print head; the controller stores the history of temperature detected by the temperature sensor; if the time measured by the timer reaches the predetermined time, the controller finds the number of changes in the temperature over the predetermined temperature in the temperature history within the measured time; and if this number of changes is a predetermined number or more, the controller sends a command for flushing of the print head to the printer. If temperatures close to the meniscus destruction temperature have been reached many times within the predetermined period of time, flushing can result in subsequent normal ejection of ink from the print head, thus ensuring an appropriate print action. If the number of changes in the temperature over the predetermined temperature in the temperature history within the measured time is one or more, but less than the predetermined number, the controller can control the driver so as to release the cap from the print head.

A second aspect of the present invention is to provide a capping device for a print head, comprising:

a cap unit having a cap for covering nozzles formed in the print head;

a driver for driving the cap unit between an intimate contact position of the cap with the print head and a release position of the cap from the print head;

a timer for measuring the time for which the print head is in intimate contact with the cap; and a controller which, if the time measured by the timer reaches a predetermined time, controls the driver so that the cap is released from the print head. According to the capping device of this aspect, unlike the capping device of the first aspect, it is based on time alone that the timing of release of the cap from the print head is controlled. The predetermined time can be set suitably in consideration of the environment where the printer with the print head is used, the frequency of use of the printer, the viscosity of ink, and so on.

A third aspect of the present invention is to provide a printer comprising:

a print head;

a cap unit having a cap for covering nozzles formed in the print head;

a driver for driving the cap unit between an intimate contact position of the cap with the print head and a release position of the cap from the print head;

a temperature sensor for detecting the temperature inside the printer; and a controller which, if the temperature detected by the temperature sensor is higher than a predetermined temperature, controls the driver so that the cap is released from the print head. According to this printer, release of the cap from the print head is performed, where necessary, by detecting the temperature inside the printer. Thus, the pressure of the gap between the cap and the print head is always kept lower than the pressure enough high to destroy the meniscus. Consequently, printing malfunction can be prevented.

A fourth aspect of the present invention is to provide a printer comprising:

a print head;

a cap unit having a cap for covering nozzles formed in the print head;

a driver for driving the cap unit between an intimate contact position of the cap with the print head and a release position of the cap from the print head;

a timer for measuring the time for which the print head is in intimate contact with the cap; and a controller which, if the time measured by the timer reaches a predetermined time, controls the driver so that the cap is released from the print head. According to this printer, release of the cap from the print head is performed, where necessary, by detecting the elapsed time since the start of capping. Thus, the pressure of the gap between the cap and the print head is always kept lower than the pressure enough high to destroy the meniscus. Consequently, printing malfunction can be prevented.

The capping devices of the first and second aspects, and the printers of the third and fourth aspects are preferred for ink jet printers.

BRIEF DESCRIPTION OF THE DRAWINGS

FIG. 4A is a side view showing the non-capping state of the capping device, while

PREFERRED EMBODIMENTS OF THE INVENTION

A capping device for a print head related to an embodiment of the present invention will now be described by reference to the accompanying drawings.

Figure 1:
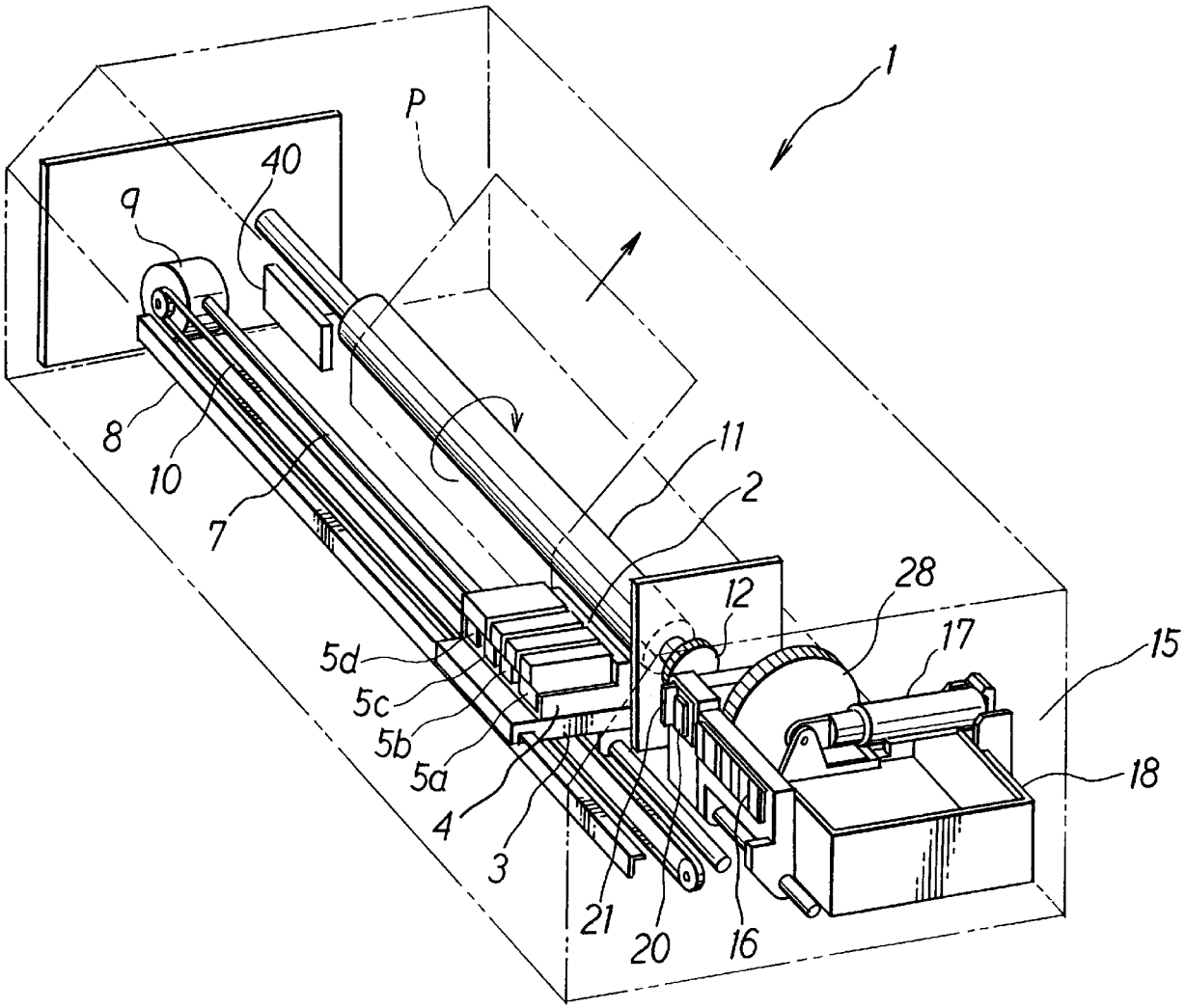
FIG. 1 is a perspective view showing an ink jet printer equipped with a capping device for a print head concerned with an embodiment of the present invention.

FIG. 1 is a perspective view showing an ink jet printer equipped with a capping device 16 for a print head concerned with the present invention. A color ink jet printer (hereinafter referred to as a printer or the printer in context) 1 has ink jet type print heads 2 for performing printing by ejecting four colors (cyan, magenta, yellow, black) of inks onto a recording medium P, such as a printing sheet. These print heads 2 have four rows of nozzles for ejecting the four colors of inks, and they are held on a carriage 3 to be driven linearly in a reciprocating manner during printing. The print heads 2 are provided integrally with a head unit 4. Ink cartridges 5*a*, 5*b*, 5*c*, 5*d* for supplying the four colors of inks to the print heads 2 are detachably mounted on the carriage 3. The carriage 3 has its front part supported by a carriage shaft 7 so as to be movable along the carriage shaft 7. A rear part of the carriage 3 is supported slidably on a guide plate 8. The reciprocating movement of the carriage 3 is made by a carriage drive motor (drive means) 9 via a belt 10.

At a position facing the print heads 2, a platen roller 11 is provided. The platen roller 11 is driven by the transmission of the drive force of a line feed motor (not shown) via a platen gear 12. The recording medium P is conveyed by the platen roller 11 to a position facing the print heads 2, and printed there. Beside the platen roller 11, a purging device 15 is provided. During the use of the print head 2, air bubbles may develop inside, or ink droplets may adhere to the ejecting surface, thereby causing ejection failure. The purging device 15 exists in order to solve this trouble and restore a satisfactory ejection state. The purging device 15 is also driven after replacement of the print head 2 or any of the ink cartridges 5*a* to 5*d*, to ensure the smooth supply of ink in the cartridge to the nozzles of the print head 2.

Forward of the purging device 15, a capping device 16 is provided for protecting the print heads. Laterally of the print region side of the capping device 16, a suction cap 20 is provided for purging the print head 2. The capping device 16 is constructed such that when the carriage 3 has moved to the capping position, the capping device 16 moves toward the nozzles of the print heads 2, and contacts the surroundings of the nozzles. This seals the nozzle portions, preventing the drying of the nozzles and ink. The suction cap 20 is a part of the purging device 15, which, when the nozzles of the print heads 2 are covered, sucks air bubbles, faulty ink, etc. in the print heads 2 by a negative pressure generated by a pump 17, thereby recovering the function of the print heads 2. The sucked defective ink is sent to a reservoir 18. Beside the suction cap 20, a wiper 21 is provided for wiping the nozzles of the print heads 2.

Figure 2:
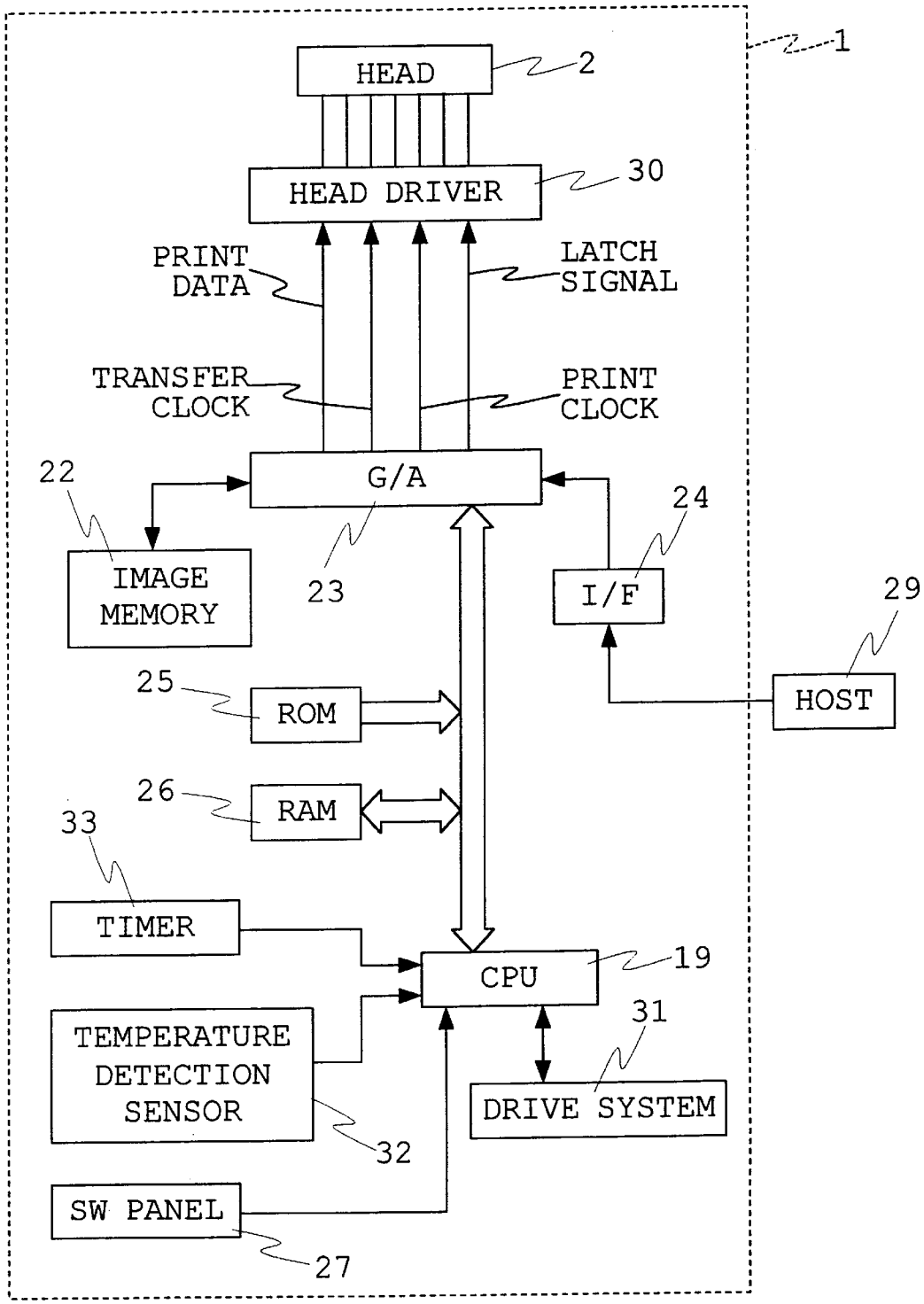
FIG. 2 is a block diagram of a control system of the printer.

FIG. 2 is a block diagram of a control system of the printer 1. The printer 1 has a G/A (gate/array) circuit 23 for control of a print action, such as print data processing, and a CPU (controller) 19 for control of the entire printer 1, control of other processings. To the G/A circuit 23, a host computer 29 is connected via an interface 24, and an image memory 22 is also connected for storing print data received from the host computer 29. A ROM 25 which stores programs for controlling a drive mechanism for the carriage 3 and a conveying mechanism for the recording medium P, and a RAM 26 which stores control data for each function block are connected to the G/A circuit 23 and the CPU 19. To the CPU 19, an operating panel 27 composed of an operating switch, etc. is connected, and a drive system 31 comprising the carriage drive motor 9, the motor for conveying the recording medium P, and so forth is also connected. To the G/A circuit 23, a head driver 30 is connected for driving the print heads 2. To the head driver 30, print data, transfer clock, print clock, and latch signal are transmitted from the G/A circuit 23. To the CPU 19, there are also connected a temperature detection sensor 32 for detecting the temperature inside the printer 1, and a timer 33 for measuring the time for which the nozzles of the print heads remain capped. Based on signals from the temperature detection sensor 32 and the timer 33, the CPU 19 performs action control of the carriage 3 for responding to pressure changes at the gap between each of the print heads 2 and caps 16*a* to 16*d* to be described later on. The temperature detection sensor 32 may be provided on the back of the carriage 3 (see FIG. 4), and may be used concurrently as a temperature sensor for measuring the temperature of the print head.

Figure 4A:
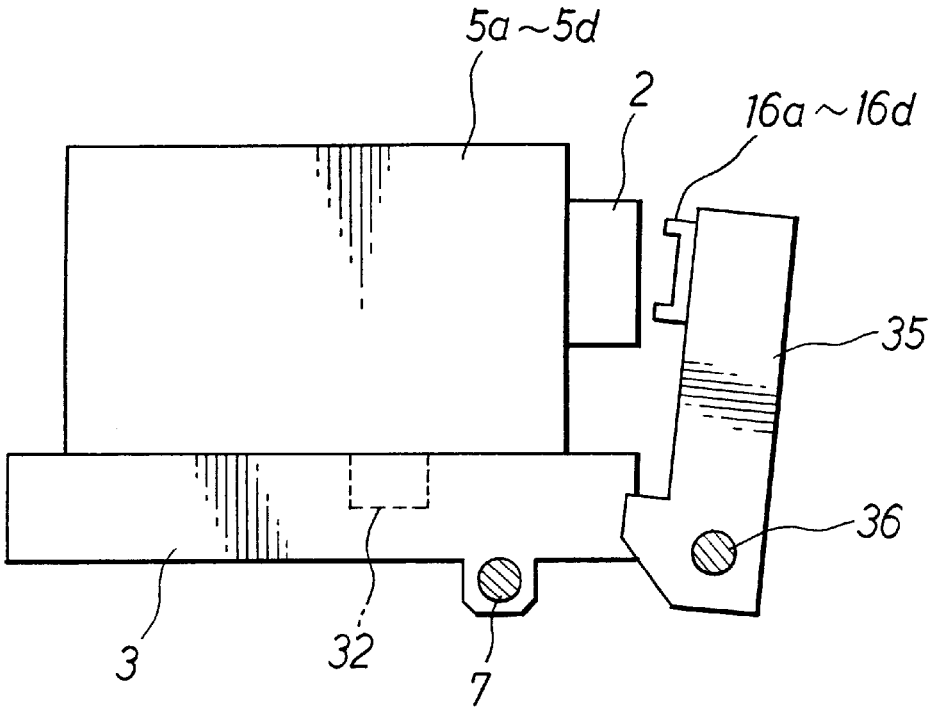
Figure 4B:
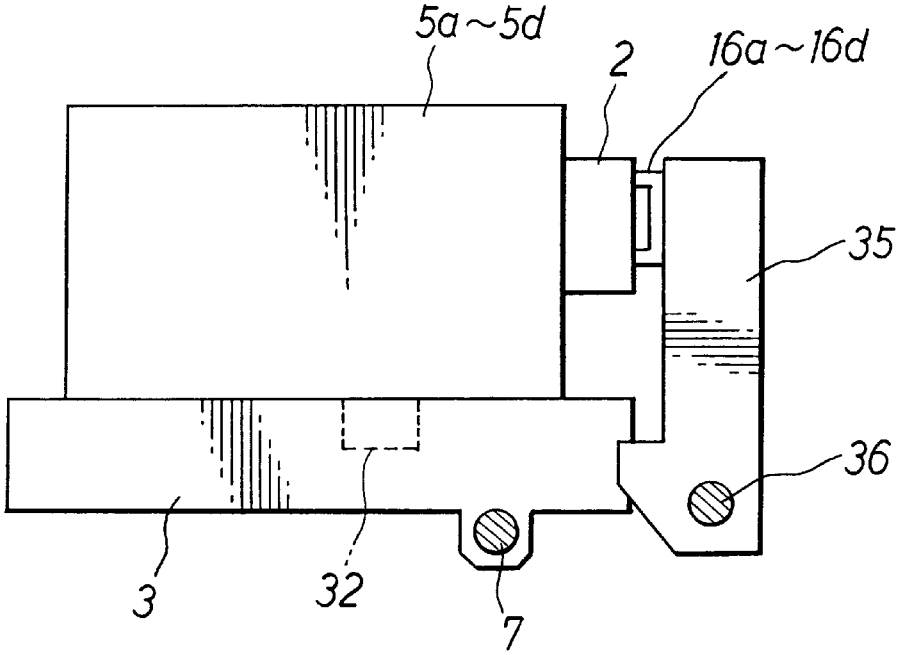
FIG. 4B is a side view showing the capping state of the capping device.
Figure 5A:
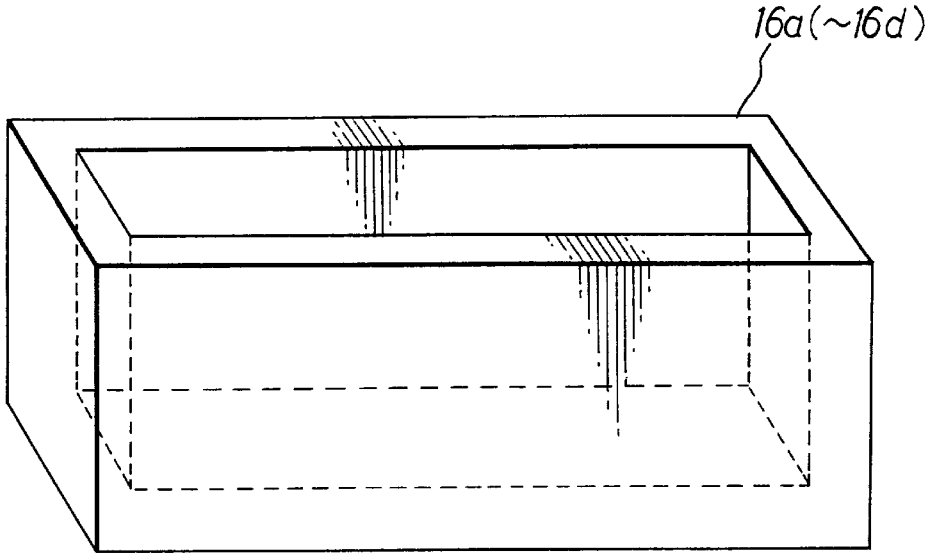
FIGS. 5A and 5B are perspective views showing two types of caps of the capping device.
Figure 5B:
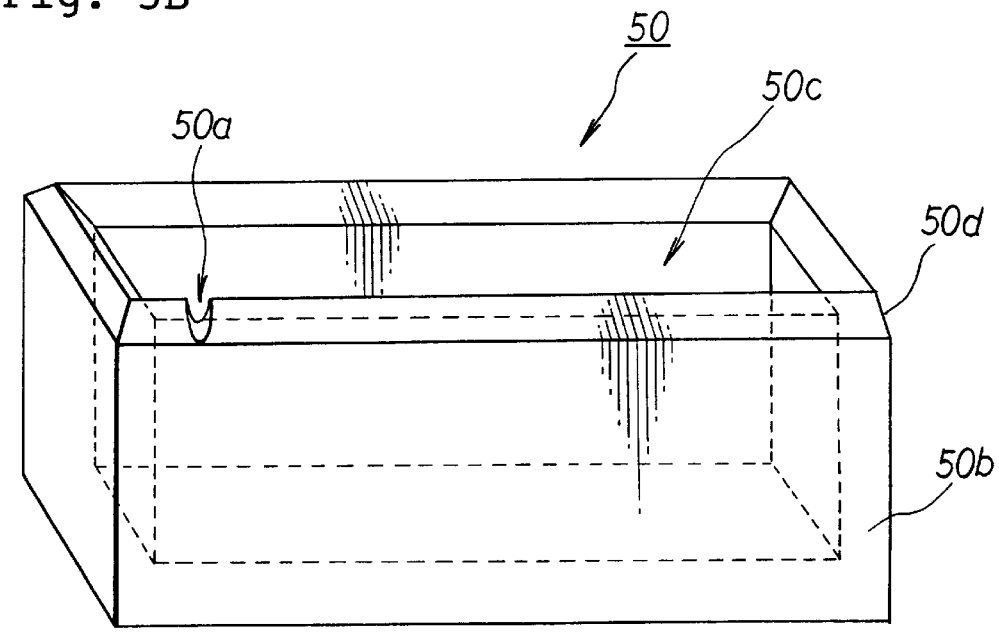

The structure and capping action of the capping device 16 will be described by reference to FIGS. 3 to 5. FIGS. 3A to 3C are each a plan view showing the positional relationship between the capping device 16 and the carriage 3 during capping. FIG. 4A is a side view showing the non-capping state of the capping device 16, while FIG. 4B is a side view showing the capping state of the capping device 16. FIGS. 5A and 5B are perspective views showing two types of caps of the capping device 16. The capping device 16 is provided with four caps 16*a*, 16*b*, 16*c*, 16*d* for capping the four rows of nozzles of the print heads 2. These caps 16*a*, 16*b*, 16*c*, 16*d* are composed of an elastic material such as butyl rubber, and are slidably and turnably supported by a guide shaft 36 via a cap unit 35. The cap unit 35 is urged by a spring 37 toward the print region. In the cap unit 35, a slide portion 35*a* is formed. At a position opposed to the slide portion 35*a*, a cam member 38 is formed in an inclined manner so as to rise toward the print head 2 as the non-print region side is approached. In the cap unit 35, an engaging stop portion 35*b* which engages and stops the carriage 3 is formed. In this embodiment, the driver for the cap unit 35 is composed of the slide portion 35*a* and the cam member 38.

The caps 16*a* to 16*d* may have a shape, as shown in FIG. 5A, which can cover and completely seal the nozzle portion of the print head 2, or may be in a shape, as shown in FIG. 5B, in which an air exposure hole 50*a* is formed at the part of each cap 50 to be in contact with the nozzles. The cap 50 shown in FIG. 5B is composed of a cap body 50*b* having an opening 50*c*, and a frame-shaped head contact portion 50*d* provided on the opening 50*c* side of the body 50*b*. The head contact portion 50*d* has a shape gradually tapering in a direction farther from the body 50*b*. By the intimate contact of the head contact portion 50*d* with the print head, capping is performed. In one side of the head contact portion 50*d*, the air exposure hole 50*a* is formed for establishing communication between the inside and the outside of the cap 50. Since the cap 50 is composed of an elastic material such as butyl rubber, the air exposure hole 50*a* closes under pressure on the print head 2 during capping. When the pressure on the print head 2 decreases for decapping, the air exposure hole 50*a* opens. Even without complete decapping, the cap space and the air can be made to communicate. Thus, a time taken to release the cap for elimination of the pressure changes can be shortened. Furthermore, the amount of movement of the carriage 3 for cap release can be decreased.

The capping action of the capping device 16 with the foregoing construction will be described.

Figure 3A:
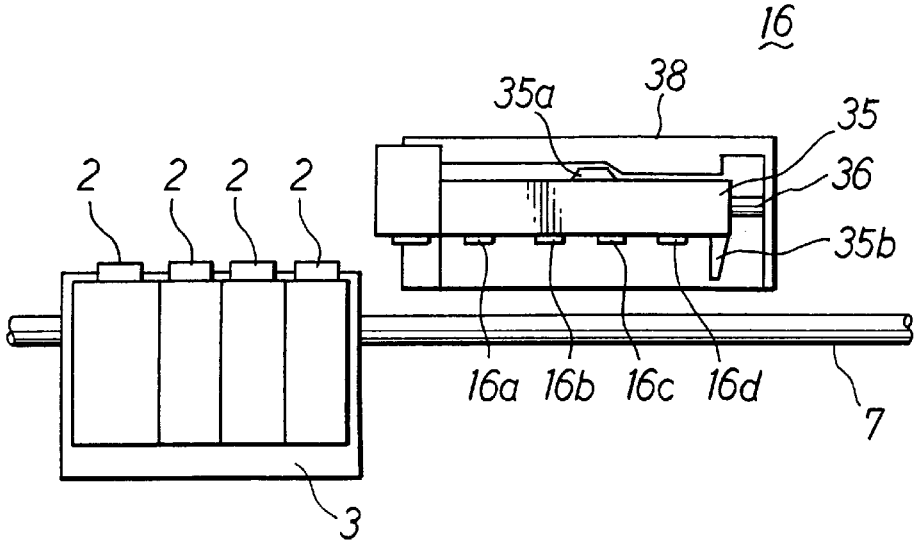
FIGS. 3A, 3B and 3C are each a plan view showing the positional relationship between a capping device and a carriage during capping.
Figure 3B:
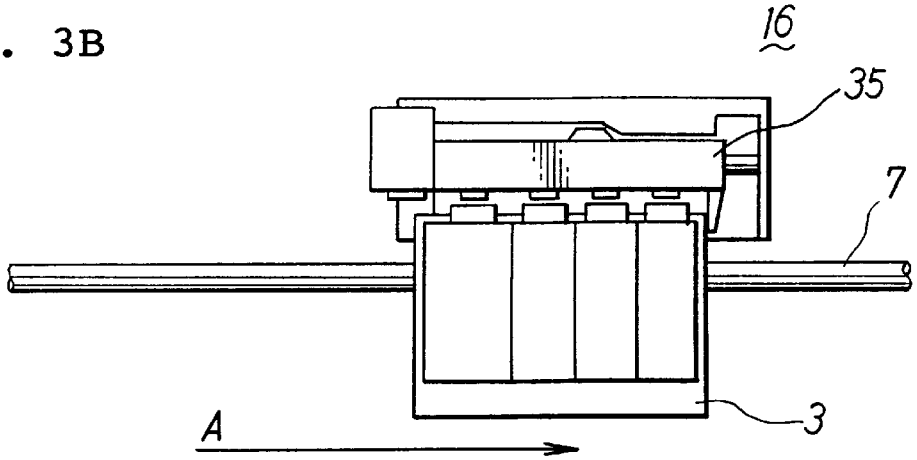
Figure 3C:
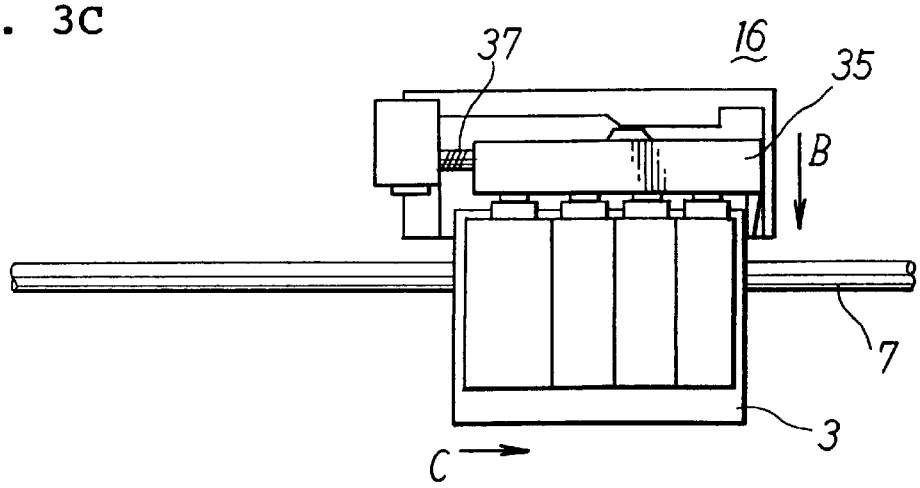

When the carriage 3 is in the print region, the cap unit 35 is at a position shown in FIG. 3A by the urging action of the spring 37. When the carriage 3 moves to the capping position, the engaging stop portion 35*b* and the carriage 3 engage each other. Following the movement of the carriage 3, the cap unit 35 slides in the direction of an arrow A (FIG. 3B, FIG. 4A). During this sliding movement, the slide portion 35*a* moves while sliding along the cam member 38. Thus, the cap unit 35, as shown by an arrow B, moves toward the carriage 3, with the caps 16*a* to 16*d* approaching the print heads 2. When the carriage 3 further moves as shown by an arrow C, the cap unit 35 further approaches the carriage 3. As a result, the print heads 2 are capped by the caps 16*a* to 16*d* (FIG. 3C, FIG. 4B). That is, as shown in FIGS. 4A and 4B, the cap unit 35 turns about the shaft 36, and the caps 16*a* to 16*d* cover the print heads 2. Then, the carriage 3 moves toward the print region. In this case, under the urging force of the spring 37, the caps 16*a* to 16*d* leave the print heads 2 while moving toward the print region. When the carriage 3 escapes from the capping position, the cap unit 35 returns to the initial position shown in FIG. 3A.

Figure 6:
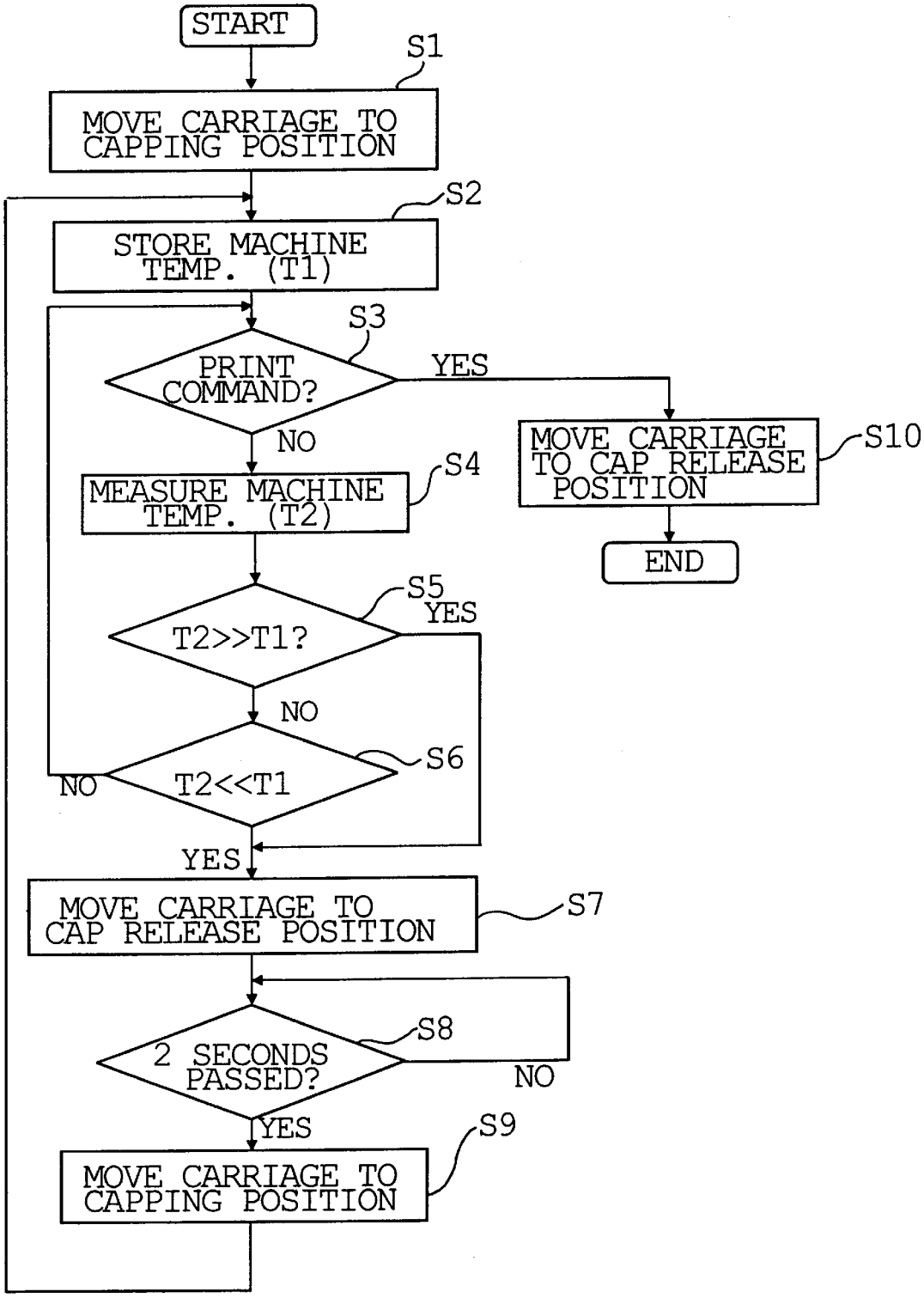
FIG. 6 is a flow chart showing a flow of processings by a first embodiment of carriage action control performed in response to changes in the temperature and volume of the gap between the print head and the cap.

A first embodiment of action control of the carriage 3, which is performed in response to changes in the temperature and volume of the gap between each of the print heads 2 and the caps 16*a* to 16*d* (the gap is called the cap space) during capping with the capping device 16 will be described by reference to a flow chart, FIG. 6. When the carriage 3 moves to the capping position and undergoes capping (S1), the temperature T1 inside the printer 1 (machine temperature) is detected by the temperature detection sensor 32, and its value is stored (S2). If a print command is issued at this time (YES at S3), the carriage 3 is moved to the print region, i.e., the cap release position (S10). If there is no print command (NO at S3), the machine temperature T2 is measured again (S4), and this temperature T2 is compared with the previously detected temperature T1 (S5, S6). If the comparison of the temperature T2 with the temperature Ti does not show a marked temperature rise or drop (e.g., $\Delta T=|T2-T1|<5°$ C.) (NO at S5 or NO at S6), the program returns to the processing at the step S3. If the comparison of the temperature T2 with the temperature Ti shows a marked temperature rise or drop (YES at S5 or YES at S6), the carriage 3 is moved out of the capping position to the cap release position (S7) in order to eliminate a pressure change associated with the temperature change of the cap space. After a lapse of a predetermined time, e.g., 2 seconds (S8), the carriage 3 is moved again to the capping position to undergo capping (S9). Then, the processing returns to the step S2.

Figure 7:
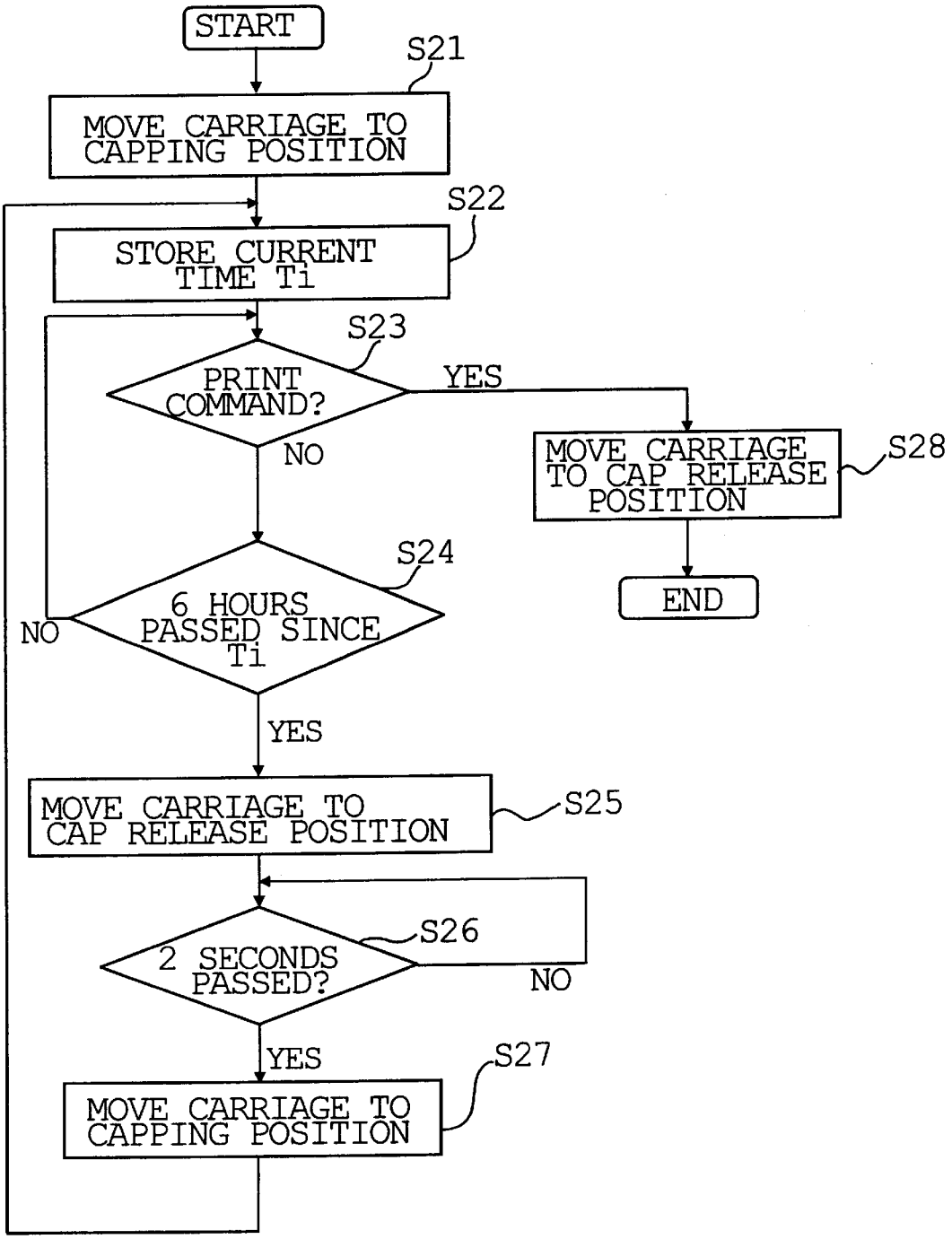
FIG. 7 is a flow chart showing a flow of processings by a second embodiment of the carriage action control.

A second embodiment of action control of the carriage 3 will be described by reference to a flow chart, FIG. 7. When the carriage 3 moves to the capping position and undergoes capping (S21), current time, i.e., the time at this time point, Ti, is stored (S22). If a print command is issued at this time (YES at S23), the carriage 3 is moved to the print region, i.e., the cap release position (S28). If there is no print command (NO at S23), and if a predetermined time of, say, 6 hours has passed (YES at S24), the carriage 3 is moved out of the capping position for decapping (moved to the cap release position) (S25) in order to eliminate a pressure change associated with the temperature change of the cap space. After the print head 2 is decapped for 2 seconds, the carriage 3 is moved again to the capping position to undergo capping (S26, S27). Then, the processing returns to the step S22.

Figure 8:
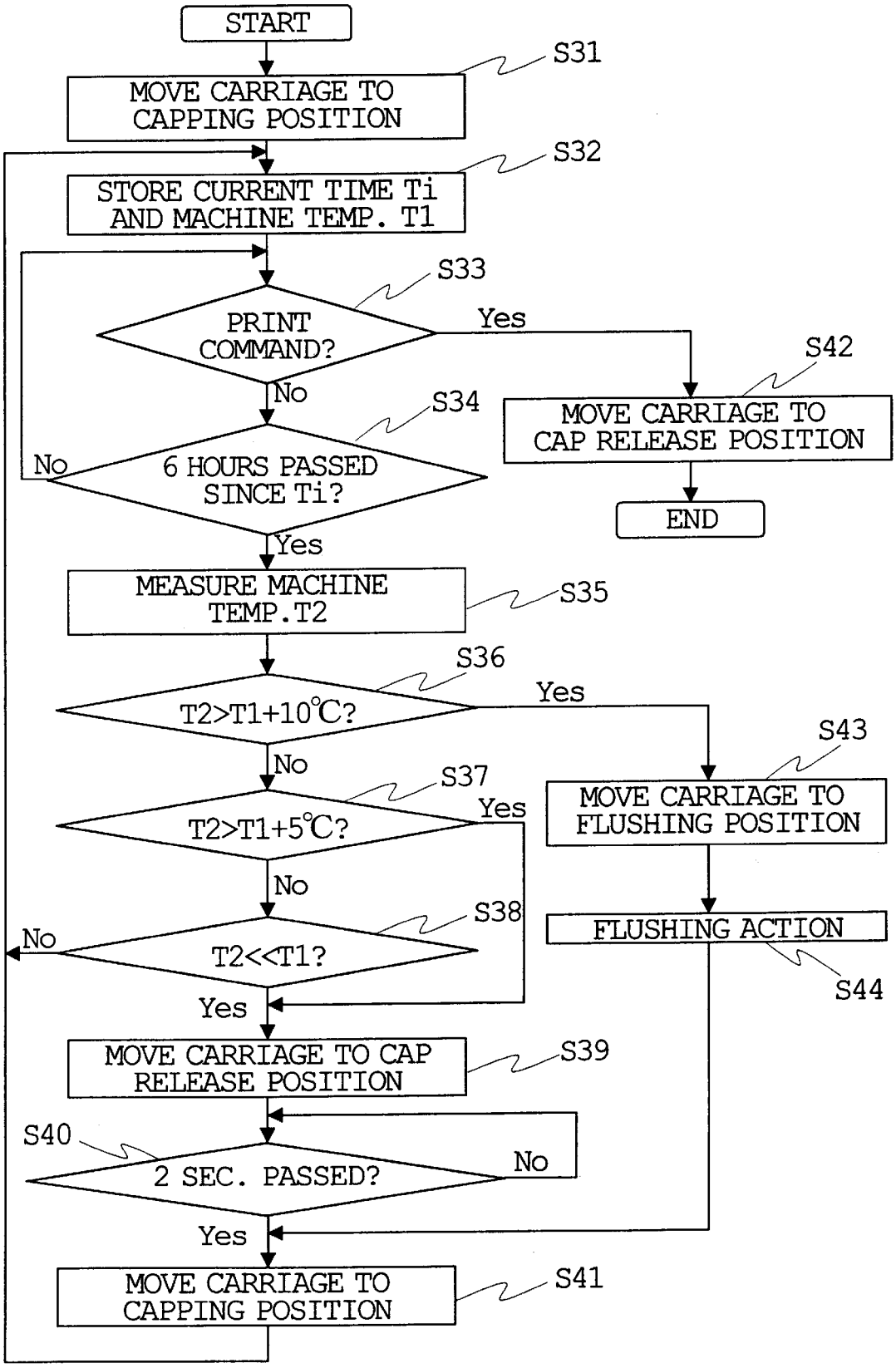
FIG. 8 is a flow chart showing a flow of processings by a third embodiment of the carriage action control.

A third embodiment of action control of the carriage 3 will be described by reference to a flow chart, FIG. 8. When the carriage 3 moves to the capping position and undergoes capping (S31), the values of the current time Ti and the machine temperature T1 are stored (S32). If a print command is issued at this time (YES at S33), the carriage 3 is moved to the print region, i.e., the cap release position (S42). If there is no print command (NO at S33), and if 6 hours have passed since the time Ti (YES at S34), the machine temperature T2 is measured again (S35). The value of T2 is compared with the previously detected machine temperature T1 (S36 to S38), and the following processing is performed in accordance with the value of the machine temperature T2: If the machine temperature T2 is higher than the machine temperature T1+10° C. (YES at S36), the carriage 3 is moved to a flushing position (a position opposed to a flushing board 40 in FIG. 1) (S43) to perform a flushing action by ejection of ink onto the flushing board 40 (S44). Then, the processing proceeds to the step S41. If the machine temperature T2 is lower than the machine temperature T1+10° C. (NO at S36), but higher than the machine temperature T1+5° C. (YES at S37), the carriage 3 is moved to the cap release position for decapping (S39). After the print head 2 is decapped for 2 seconds, the carriage 3 is moved again to the capping position for capping (S40, S41). Then, the processing returns to the step S32. If the answers at S36 and S37 are NO, then it is examined whether the machine temperature T2 has markedly lowered from the machine temperature T1, namely, whether the temperature has sharply dropped (e.g. $\Delta T = T1 - T2 > 5$)(S38). If the tempera(YES at sharply dropped (YES at S38), the processings at the steps S39–S41 are performed. If the answer is NO at S38, the processing returns to the step S32. This third embodiment is a combination of the first and second embodiments.

Figure 9:
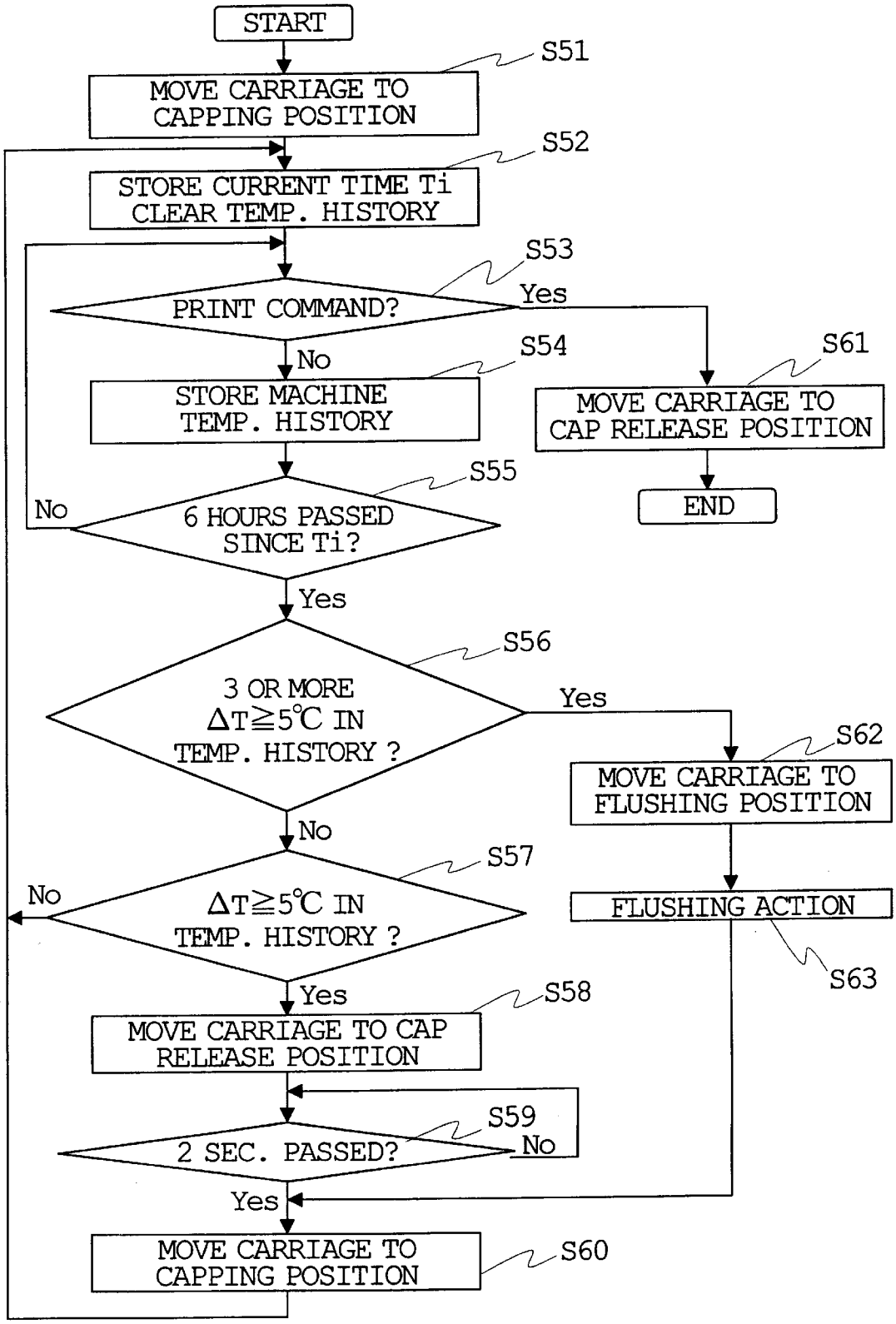
FIG. 9 is a flow chart showing a flow of processings by a fourth embodiment of the carriage action control.

A fourth embodiment of action control of the carriage 3 will be described by reference to a flow chart, FIG. 9. When the carriage 3 moves to the capping position and undergoes capping (S51), the value of the current time Ti is stored, and the history of the machine temperature is cleared (S52). If a print command is issued at this time (YES at S53), the carriage 3 is moved to the print region, i.e., the cap release position (S61). If there is no print command (NO at S53), the history of the machine temperature detected is stored (S54). If 6 hours have passed since the time Ti (YES at S55), the temperature history is investigated (S56). If the temperature history shows 3 or more changes in temperature of higher than 5° C. (YES at S56), the carriage 3 is moved to the flushing position (S62) to perform a flushing action (S63). Then, the processing proceeds to the step S60. If the temperature history shows temperature changes of higher than 50° C. that happened less than 3 times (NO at S56, YES at S57), the carriage 3 is moved to the cap release position for decapping (S58). After the print head 2 is decapped for 2 seconds, the carriage 3 is moved again to the capping position to undergo capping (S59, S60). Then, the processing returns to the step S52. If there is no temperature change of higher than 5° C. recorded in the temperature history (NO at S56 and S57), the program returns to the processing at the step S52.

As described above, if the temperature of the nozzle sealing space capped with the capping device for the print head according to any of the embodiments varies according to a change in the machine temperature, decapping is performed to keep the pressure inside this space constant. Thus, the space pressure is always kept lower than the meniscus destruction pressure of the print head, and printing failure can be prevented.

The present invention is not restricted to the above-described embodiments, but various changes and modifications may be made. In each of the embodiments, for example, the duration of decapping for eliminating pressure changes is described as 2 seconds. However, it is not limited to 2 seconds, but many be any number of seconds that can eliminate pressure changes. The temperature as a basis for deciding whether to release the cap or whether to perform flushing is not restricted to the values of temperature revealed in the embodiments. It should be changed, where necessary, depending on the suitability of the printer, the environment, etc.

In the embodiments, moreover, capping is controlled based on temperature changes inside the printer 1. However, capping control may be carried out based on the temperature of the gap sealed by the print head 2 and the caps 16*a* to 16*d*. In this case, the temperature detection sensor 32 serves to detect the temperature of the gap. The capping device of the present invention is applicable to various types of print heads. It is effective particularly for print heads using piezoelectric elements, for example, of the Kaiser type, the stem type, and the laminate type, as well as shear mode type print heads.

What is claimed is:

1. A capping device for a print head, comprising:

a cap unit having a cap for covering nozzles formed in the print head;

a driver for driving the cap unit between an intimate contact position of the cap with the print head and a release position of the cap from the print head;

a temperature sensor for detecting the temperature of the capping device; and a controller which, if the temperature detected by the temperature sensor is higher than a predetermined temperature, controls the driver so that the cap is released from the print head to prevent a meniscus of the print head from being destroyed.

2. The capping device according to claim 1, wherein the predetermined temperature is set based on a temperature at which the meniscus of the print head is destroyed.

3. The capping device according to claim 1, further comprising a timer for measuring the time for which the print head is in intimate contact with the cap, wherein if the time measured by the timer reaches a predetermined time and if the temperature detected by the temperature sensor exceeds the predetermined temperature, the controller controls the driver so that the cap is released from the print head.

4. The capping device according to claim 3, wherein the controller is connected to a printer having the print head, the controller stores the history of the temperature detected by the temperature sensor, if the time measured by the timer reaches the predetermined time, the controller finds the number of changes in the temperature over the predetermined temperature in the temperature history within the measured time, and if this number of changes is more than a predetermined number, the controller sends a command for flushing of the print head to the printer.

5. The capping device according to claim 4, wherein if the number of changes in the temperature over the predetermined temperature in the temperature history within the measured time is one or more, but less than the predetermined number, the controller controls the driver so that the cap is released from the print head.

6. The capping device according to claim 1, wherein the cap has a box-shaped cap body having an opening, and a frame-shaped print head contact portion provided at the opening side of the box-shaped cap body, and a hole for communication between the inside and the outside of the cap is formed in a part of the frame-shaped print head contact portion.

7. The capping device according to claim 6, wherein the frame-shaped print head contact portion extends from the opening side of the cap body so as to become thinner as it becomes farther from the cap body.

8. A capping device for a print head, comprising:

a cap unit having a cap for covering nozzles formed in the print head;

a driver for driving the cap unit between an intimate contact position of the cap with the print head and a release position of the cap from the print head;

a timer for measuring the time for which the print head is in intimate contact with the cap during operation; and a controller which, if the time measured by the timer reaches a predetermined time, controls the driver so that the cap is released from the print head.

9. The capping device according to claim 8, wherein the predetermined time is set based on the time during which the print head reaches a temperature of meniscus destruction.

10. A printer comprising:

a print head;

a cap unit having a cap for covering nozzles formed in the print head;

a driver for driving the cap unit between an intimate contact position of the cap with the print head and a release position of the cap from the print head;

a temperature sensor for detecting the temperature inside the printer; and a controller which, if the temperature detected by the temperature sensor is higher than a predetermined temperature, controls the driver so that the cap is released from the print head to prevent a meniscus of the print head from being destroyed.

11. The printer according to claim 10, wherein the predetermined temperature is set based on a temperature at which the meniscus of the print head is destroyed.

12. The printer according to claim 10, further including:

a timer for measuring the time for which the print head is in intimate contact with the cap, and a controller which, if the time measured by the timer reaches a predetermined time and if the temperature detected by the temperature sensor exceeds a predetermined temperature, controls the driver so that the cap is released from the print head.

13. The printer according to claim 12, wherein the controller stores the history of the temperature detected by the temperature sensor, if the time measured by the timer reaches the predetermined time, the controller finds the number of changes in the temperature over the predetermined temperature in the temperature history within the measured time, and if this number of changes is a predetermined number or more, the controller causes the print head to be flushed.

14. The printer according to claim 13, wherein if the number of changes in the temperature over the predetermined temperature in the temperature history within the measured time is one or more, but less than the predetermined number, the controller controls the driver so that the cap is released from the print head.

15. The printer according to claim 10, further comprising a timer for measuring the time for which the print head is in intimate contact with the cap, wherein the controller stores a temperature T1 at the start of capping, if the difference between a temperature T2 detected after a lapse of a predetermined time and the temperature T1 is more than a predetermined first temperature difference, the controller controls the print head so as to perform a flushing action, and if the difference between the temperature T2 and the temperature T1 is more than a predetermined second temperature difference, but less than the first temperature, the controller controls the driver so that the cap is released from the print head.

16. The printer according to claim 10, wherein the cap has a box-shaped cap body having an opening, and a frame-shaped print head contact portion provided at the opening side of the box-shaped body, and a hole for communication between the inside and the outside of the cap is formed in a part of the frame-shaped print head contact portion.

17. The printer according to claim 16, wherein the frame-shaped print head contact portion extends from the opening side of the cap body so as to become thinner as it becomes farther from the cap body.

18. The printer according to claim 10, wherein the printer is an ink jet printer.

19. A printer comprising:

a print head;

a cap unit having a cap for covering nozzles formed in the print head;

a driver for driving the cap unit between an intimate contact position of the cap with the print head and a release position of the cap from the print head;

a timer for measuring the time for which the print head is in intimate contact with the cap during operation; and a controller which, if the time measured by the timer reaches a predetermined time, controls the driver so that the cap is released from the print head.

20. The printer according to claim 19, wherein the predetermined time is set based on the time during which the print head reaches a temperature of meniscus destruction.

21. The printer according to claim 19, wherein the printer is an ink jet printer.

* * * * *